US005597450A

United States Patent [19]

Baker et al.

[11] Patent Number: 5,597,450

[45] Date of Patent: Jan. 28, 1997

[54] PAPER MACHINE DRYER FABRICS CONTAINING HOLLOW MONOFILAMENTS

[75] Inventors: Samuel Baker, Carleton Place; James Harrison, Kanata, both of Canada

[73] Assignee: JWI Ltd, Kanata, Canada

[21] Appl. No.: 290,849

[22] PCT Filed: Feb. 25, 1993

[86] PCT No.: PCT/CA93/00075

§ 371 Date: Oct. 24, 1994

§ 102(e) Date: Oct. 24, 1994

[87] PCT Pub. No.: WO93/17180

PCT Pub. Date: Sep. 2, 1993

Related U.S. Application Data

[63] Continuation-in-part of Ser. No. 982,118, Nov. 25, 1992, abandoned, which is a continuation of Ser. No. 843,155, Feb. 28, 1992, abandoned.

[51] Int. Cl.[6] ..... D21F 7/12

[52] U.S. Cl. ..... 162/348; 162/902; 162/903; 139/383 A

[58] Field of Search ..... 162/348, 900, 162/902, 903; 428/229, 297, 298; 34/243 R; 139/383 A

[56] References Cited

U.S. PATENT DOCUMENTS

| | | |
|---|---|---|
| 4,251,588 | 2/1981 | Goetemann et al. . |
| 4,290,209 | 9/1981 | Buchanan et al. . |
| 4,345,730 | 9/1982 | Leuvelink . |
| 4,359,501 | 11/1982 | Ditullio . |
| 4,481,079 | 11/1984 | Dawes . |
| 4,567,007 | 1/1986 | Gauthier . |
| 4,632,716 | 12/1986 | Smith . |
| 4,755,420 | 7/1988 | Baker . |
| 4,820,571 | 4/1989 | Searfass . |
| 5,103,874 | 4/1992 | Lee . |
| 5,368,696 | 11/1994 | Cunnane, III et al. ..... 162/900 |

FOREIGN PATENT DOCUMENTS

| | | |
|---|---|---|
| 36527 | 9/1981 | European Pat. Off. . |
| 2419751 | 1/1982 | Germany . |
| 8706893 | 8/1987 | Germany . |
| 2216914 | 10/1989 | United Kingdom . |

OTHER PUBLICATIONS

ASTM Designation: D737–75 "Standard Test Method for Air Permeability of Textile Fabrics".

TAPPI, Jul. 1968, vol. 51, No. 7 "Air Movement Induced by Felts and Fabrics and Its Ventilation Effect on Dryer Pockets".

*Primary Examiner*—Karen M. Hastings

*Attorney, Agent, or Firm*—Cushman Darby & Cushman IP Group of Pillsbury Madison & Sutro LLP

[57] ABSTRACT

A paper machine dryer fabric includes hollow thermoplastic monofilaments to replace at least a portion of the wefts, also known as cross-machine direction strands. Fabrics including such monofilaments may be either a woven fabric, or a spiral fabric. The deformable nature of the hollow monofilaments decreaes the air permeability of the fabric, and in the case of spiral fabrics, improves monofilaments retention within the helical coils between the hinge yarns. The hollow monofilaments have a solidity in the range of from about 60% to about 75%. A suitable thermoplastic is polyethylene terephthalate. Hollow monofilaments do not have the disadvantages of other deformable yarns, such as spun yarns, multifilament yarns or plied monofilament yarns, each of which tend to hold and entrap within their structure both water and foreign matter.

3 Claims, 4 Drawing Sheets

PAPER MACHINE DRYER FABRICS CONTAINING HOLLOW MONOFILAMENTS

CROSS-REFERENCE TO RELATED APPLICATIONS

This is a national stage application of PCT/CA93/00075, filed Feb. 25, 1993, which is a continuation-in-part of U.S. application Ser. No. 07/982,118, filed Nov. 25, 1992, now abandoned, which is a continuation of U.S. application Ser. No. 07/843,155, filed Feb. 28, 1992, now abandoned.

FIELD OF THE INVENTION

This invention relates to fabrics intended for use in the manufacture of paper and like products, in which hollow monofilaments replace at least a portion of the wefts, also known as cross-machine directions strands. The invention is particularly applicable to paper machine dryer fabrics.

DESCRIPTION OF THE PRIOR ART

The primary function of a dryer fabric is to hold the paper web in contact with the heated surfaces of the dryer cylinders. This increases the efficiency of heat transfer and improves the flatness of the paper.

An important property of dryer fabrics intended for use in modern, high-speed paper making machines is low permeability to air flow. Dryer fabrics must have low air permeabilities so as to prevent sheet flutter and, ultimately, breakage of the sheet (as documented by Race, Wheeldon, et al. in TAPPI, vol. 51, no. 7, July 1968). Low air permeability values may be considered to be those in the range of 127 $cm^3/cm^2 \cdot s$ (250 $ft^3/min/ft^2$) or below. It is also desirable that the air permeability of the fabric be constant throughout both the fabric itself, and its operational life.

It is difficult to obtain low air permeabilities in woven dryer fabrics when solid monofilaments are used as the weft strands. Manufacturers of dryer fabrics have thus traditionally resorted to incorporating spun yarns, multifilament yarns or plied monofilaments in order to obtain low air permeabilities in conventional dryer fabric designs. These types of yarns, however, make it difficult to accurately control fabric air permeability during manufacture. They also allow foreign matter to become entrapped in the fabric, which changes the air permeability of the fabric throughout its life on the paper making machine. Trapped contaminants are usually distributed unevenly in the fabric, and will cause uneven drying of the paper web. The use of spun yarns, multifilament yarns, or plied monofilaments in dryer fabrics also reduces the efficiency with which water is evaporated out of the paper web, because water tends to condense and be retained within such yarns.

Another method of lowering fabric air permeability is to use machine direction strands that are essentially rectangular in cross-section. Such a method is disclosed by Buchanan et al. in U.S. Pat. No. 4,290,209. This patent also discloses the use of shaped or hollow monofilaments as weft strands to further reduce dryer fabric air permeability. However, it does not teach the critical physical parameters required for the hollow monofilaments, such as strand diameter, or solidity of cross-sectional area. No data is disclosed as to the effectiveness of hollow monofilament weft strands in reducing fabric air permeability.

Goetemann, et al., in U.S. Pat. No. 4,251,588 teach the use of hollow monofilaments to improve dimensional stability and flex life in paper machine clothing. The range of void fractions in the yarn cross-sectional area disclosed is from 0.03 to 0.15 (3% to 15%), or a range of solidities of from 97% to 85%. Solidities less than 85% were not recommended because such monofilaments would flatten from a circular cross section to a void-free filament. Goetmann et al. also teach that conventional techniques may be used to weave these hollow monofilaments into papermaking fabrics without collapsing them. No consideration is given to any interrelationship between the strand diameter of the hollow monofilament, its solidity, and the space available within the woven structure to accommodate the yarns. The use of these hollow monofilaments for the purpose of reducing fabric air permeability is not taught.

It is also difficult to obtain low fabric air permeabilities in spiral fabrics. These fabrics are assembled from a multiplicity of helical coils which are intermeshed and connected together in a hinged relationship by hinge yarns, substantially as described by Kerber in DE 2,419,751, Leuvelink in U.S. Pat. No. 4,345,730, and Dawes in U.S. Pat. No. 4,481,079. The air permeability of these fabrics is typically altered by inserting a shaped, solid monofilament into the space within the helical coils and between the hinge yarns. The cross-sectional shape of the inserted monofilament is determined so as to efficiently fill the space between the hinge yarns, thus lowering the air permeability of the fabric. Commonly used shapes include: ellipses, rectangles, trapezoids, a "D", or a "dog bone". It is also known to perforate such yarns along their length so as to further assist in controlling air permeability, as taught by Gauthier in U.S. Pat. No. 4,567,077. However, a disadvantage of using shaped monofilaments in spiral fabrics is that they are not effectively locked in position and are prone to falling out during the drying operation on the paper making machine.

The predominant material used in the manufacture of dryer fabrics is polyethylene terephthalate (PET) that has been stabilized to reduce its rate of hydrolytic degradation. However, in the harshest dryer sections, where high temperatures (greater than 150° C.) occur, other more expensive polymers are commonly used. Such polymers include: blends of. polyphenylene sulphide (PPS), as disclosed by Baker et al. in U.S. Pat. No. 4,755,420, and polyetherether ketone (PEEK), as disclosed by DiTullio in U.S. Pat. No. 4,359,501 and Searfass in U.S. Pat. No. 4,820,571. While vastly superior to PET in hydrolysis resistance, their higher cost restricts their usage due to economic considerations.

SUMMARY OF THE INVENTION

This invention seeks to overcome the aforementioned deficiencies of the prior art by providing a papermaker's heatset fabric, for use in paper making or like machines, wherein at least a portion of the weft strands are hollow thermoplastic monofilaments which have a solidity in their undeformed cross-sectional area of from about 50% to about 80%, and which have a diameter such that they are deformed in the weft passageway to be filled in the woven fabric during heatsetting.

Thus in a first broad embodiment, this invention seeks to provide a woven, heatset fabric, for use in papermaking and like machines, wherein at least a portion of the weft strands are hollow thermoplastic polymer monofilaments which have a solidity in their undeformed cross-sectional area of from about 50% to about 80%, and wherein the circumference of said hollow monofilaments is greater than, or equal to, the perimeter of the weft passageway they are to occupy in the fabric after heatsetting.

In a second broad embodiment, this invention seeks to provide a heatset spiral fabric, for use in papermaking and like machines, comprising a plurality of helical coils interconnected by hinge yarns, including hollow monofilament weft strands having a solidity in their undeformed cross sectional area of from about 50% to about 80%, located within the helical coils and between the hinge yarns, wherein the diameter of hollow monofilaments is greater than the interior length of the minor axis of the helical coils in the heatset fabric, and further wherein the hollow monofilaments are deformed by the helical coils as a consequence of heatsetting of the fabric.

In either a woven or spiral fabric according to this invention, the hollow monofilaments will generally have an outside diameter in the range of between about 0.25 mm and 2.1 mm.

For the purposes of the present application, the following terms are defined for use herein as shown:

Heatsetting: processes such as are well known to those skilled in the art whereby a fabric structure is stabilized under conditions of elevated temperature and tension;

Perimeter of the weft passageway: the perimeter of the projection of the passageway into which a weft yarn is to be placed, onto a plane which is normal to the weft direction. It is understood that such a passageway will not have a constant or continuous cross-section in space along the length of the weft strand, and therefore the hollow monofilament will not be squeezed uniformly along its length at every warp intersection;

Solidity: the percentage of solid material which is present at any cross-section through the undeformed hollow monofilament prior to heatsetting, relative to the total cross-sectional area of the monofilament that is enclosed by its circumference at that cross-section; and Weft: cross-machine direction strands of a woven fabric, or strands which have been inserted into the helices and between the hinge yarns of a spiral fabric.

Unless otherwise stated, all references made below to the diameter of the hollow monofilaments of this invention assume that these monofilaments have not been deformed in any way by heat setting.

The solidity of the hollow monofilaments intended for use in the paper machine fabrics of this invention is critical. We have found that the useful range of solidities is from about 50% to about 80% with from about 55% to about 78% being preferable, and from about 60% to 75% most preferable. We have experimentally determined that solidities within this range will provide these monofilaments with adequate deformational capability, a critical factor in lowering the air permeability of a fabric. If the solidity is too low, the hollow monofilaments may fracture or deform excessively, or be destroyed during weaving. If the solidity of the hollow monofilaments is too high, inadequate deformation occurs and the resulting reduction in fabric air permeability will be insignificant. This range of solidity also provides the monofilaments with sufficient mechanical strength so as to withstand the rigours of fabric creation, heat setting, seaming, assembly and subsequent use in the paper machine.

The sizing of these hollow monofilaments is an important feature of this invention. We have discovered that the effectiveness of the hollow monofilaments is greatest when their exterior circumference, prior to heatsetting, is greater than or equal to the perimeter of the weft passageway they are to occupy in a woven fabric after heatsetting. If their circumference is less than this value, then air permeability can only be reduced by increasing the weft count (number of wefts per unit length) of the fabric. This will reduce the perimeters of the weft passageways in the cloth, thereby allowing the hollow monofilaments to now fill the space between the warp yarns.

We have found that, for currently available fabrics, the useful circumference of the hollow monofilaments of this invention, for use in woven fabrics, will correspond to diameters of from about 0.25 mm to about 1.2 mm. Hollow monofilaments whose circumference corresponds to diameters of from about 0.50 mm to about 2.1 mm will be of use in spiral fabrics.

The outer diameter of a hollow monofilament that will completely fill the perimeter of the available space in a heatset fabric is estimated by calculating the perimeter of the shape to be filled, and equating that value to the outer circumference of the hollow monofilament, hence its outside diameter, using the relation:

$$C=\pi d. \qquad \text{[Equation 1]}$$

where

C=circumference, and d=diameter.

If the circumference of the hollow monofilament is selected so as to be greater than or equal to the perimeter of the weft passageway in the heatset fabric, the maximum solidity of the hollow monofilament which will not alter the geometry of the fabric should then be determined. Increasing the solidity beyond this maximum generally increases fabric thickness which, in turn, increases air permeability.

If the outer diameter of the monofilament is calculated using Equation 1, and is equal to the perimeter of the area to be filled, then the maximum solidity can be calculated by assuming that all of the solid material of the round hollow monofilament is deformed either elastically or plastically during weaving and heatsetting until the void space of the hollow monofilament is entirely consumed. The calculations which follow assume that the material is incompressible and that the fabric is heatset, unless indicated otherwise.

If the perimeter of the weft passageway to be filled is, for example, a square whose sides are of a length a, then the perimeter C of the square is:

$$C=4a. \qquad \text{[Equation 2]}$$

Assuming the circumference of the hollow monofilament is equal to this perimeter, then from Equation 1:

$$C=4a=\pi d. \qquad \text{[Equation 3]}$$

Solving for d, $$d=(4/\pi)a. \qquad \text{[Equation 4]}$$

This is the minimum diameter of a hollow monofilament that will fill the available space.

Solidity is defined as:

$$S=(A_s/A_T)\times 100, \qquad \text{[Equation 5]}$$

where

S=solidity of the hollow monofilament, $A_s$=cross sectional area of the hollow monofilament that is occupied by solid material, and $A_T$=total cross sectional area bounded by the outside diameter of the hollow monofilament.

$A_s$ cannot exceed the cross sectional area to be filled, thus the maximum $A_s$ is equal to the cross sectional area to be filled, when the hollow monofilament is completely deformed to a void-free filament; hence:

$$A_s=a^2 \quad \text{[Equation 6]}$$

and the total cross sectional area of the hollow monofilament is $$A_T=(\pi/4)d^2. \quad \text{[Equation 7]}$$

Substituting and solving for solidity S:

$$S=[a^2/(\pi/4)d^2]\times 100 \quad \text{[Equation 8]}$$

Substituting d from Equation 4:

$$S=\{[(\pi/4)d]^2/[(\pi/4)d^2]\}\times 100=S=(\pi/4)\times 100$$

$$S\approx 78.5\%$$

The above calculation demonstrates that a hollow monofilament whose solidity is greater than 78.5% must alter the geometry of the fabric if it is also sized in its outside diameter so as to fill the perimeter of a square opening. Use of hollow monofilament size and solidity combinations which will alter fabric geometry are not recommended. These calculations are therefore intended to:

1) guide the user in choosing the optimum outside diameter of the hollow monofilament for a particular application, and
2) indicate the maximum solidity which can be used at that diameter without altering the geometry of the fabric.

It is well known that heatsetting reduces the perimeter of the weft passageways in the fabric, and those skilled in this art will appreciate that the size of these weft passageways after heatsetting cannot be measured beforehand. As a guide only, the effective size of the hollow monofilaments for use in the fabrics of this invention may be estimated by measuring the perimeter of the weft passageways in the fabric prior to heatsetting, and then sizing the hollow monofilaments so that their circumference is greater than, or equal to, that perimeter. However, care must be taken to ensure that the solidity of the hollow monofilaments is low enough so as not to alter the geometry of the fabric after heatsetting.

We have experimentally determined that the practical lower limit of the solidity of these hollow monofilaments for paper machine fabric applications is about 50%, and is controlled by two unexpected factors.

1) Hollow monofilaments with solidities below 50% tend to buckle and collapse, rather than deform and take the shape of the perimeter they are to occupy, thus rendering them ineffective. This is particularly true when the circumference of the monofilament is equal to or greater than the perimeter of the space to be filled in the heatset fabric.
2) Hollow monofilaments with solidities below 50% are prone to crushing, and is easily damaged in industrial looms.

The present invention seeks to provide a woven dryer fabric, for use in the manufacture of paper and like products, whose air permeability is both low and uniformly constant throughout. This objective is achieved in practice by incorporating hollow monofilaments of optimum strand diameter and solidity as at least a portion of the fabric weft strands.

This invention also seeks to provide a spiral fabric, for use in the dryer section of paper making and like machines, whose air permeability is both low and uniformly constant throughout. This objective is achieved in practice by placing hollow monofilaments in the spaces between the hinge yarns within the helical coils of these fabrics, thereby eliminating any need to provide a specially shaped monofilament. The deformable nature of the hollow monofilaments improves their retention within the spiral fabric during its operation on the paper making machine, thus reducing the incidence of fabric failure due to loss of the solid, prior art yarns which had been "stuffed" into these spaces.

Incorporation of hollow monofilaments in at least a portion of the weft positions will provide the novel fabrics of this invention with the following advantages over fabrics of the prior art:

1) a lower air permeability can be achieved while maintaining the all-monofilament characteristic of the fabric, with the resulting benefits of cleaner operation;
2) less moisture is carried by the fabric;
3) a more consistent and uniform air permeability is provided throughout the fabric, because the physical characteristics of hollow monofilaments are inherently less variable than those of spun yarns, multifilament yarns or plied monofilaments; and
4) retention of spiral fabric weft under paper making machine operating conditions is improved.

Further, the novel fabrics of this invention require less material, by weight, to manufacture than comparable prior art fabrics because the hollow monofilaments have less mass per unit length than solid monofilaments of the same diameter. Their use is particularly advantageous when expensive polymers are required.

In addition, the weavability of paper machine fabrics can be improved by incorporating hollow monofilaments as at least a portion of the weft yarns. Since the hollow monofilaments have less mass than comparably sized solid monofilaments, their inertia is lower. This reduces problems associated with the acceleration and deceleration of large diameter monofilaments on high speed weaving looms, which, in turn, reduces weaving defects in the fabrics.

The incorporation of hollow monofilaments into paper making fabrics so as to reduce their air permeability is effective in both multi-layer and single layer fabric designs. A multi-layer fabric is one in which the weft strands lie in a series of essentially discrete tiers or planes within the fabric. A single layer fabric is one in which the weft strands lie in essentially one common plane within the fabric.

Multi-layer fabrics, manufactured in accordance with the teachings of this invention, may contain hollow monofilaments selectively positioned in all layers, selected layers, or in only one layer, of a fabric.

BRIEF DESCRIPTION OF THE DRAWINGS

The present invention will now be described with reference to the examples illustrated by the accompanying drawings in which.

DETAILED DESCRIPTION OF THE INVENTION

Figure 1:
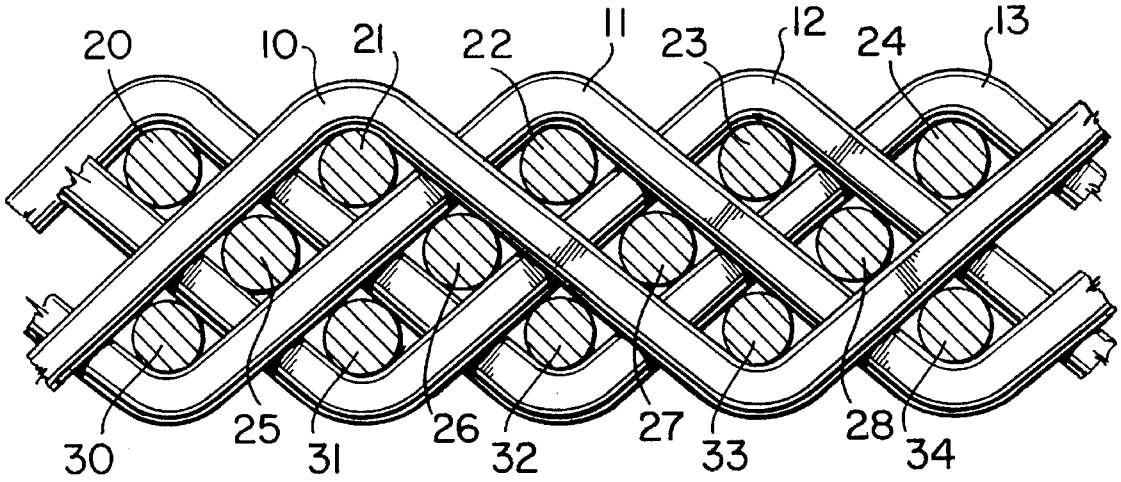
FIG. 1 PRIOR ART
FIG. 1 is a sectional view of an all-monofilament multi-layer dryer fabric of the prior art, in which all weft strands are solid monofilaments.

Referring first to FIG. 1, there is shown diagrammatically the construction of an all-monofilament, 4-shaft, 12-repeat, multilayer dryer fabric of a design that is commonly used in the papermaking industry. FIG. 1 illustrates the cross-sectional appearance of said fabric following heatsetting. There are four consecutive warp strands, 10, 11, 12 and 13. The weft strands comprise three layers. In sequence from the top of FIG. 1, these are strands 20, 21, 22, 23 and 24; in the middle, strands 25, 26, 27 and 28; and at the bottom, strands 30, 31, 32, 33 and 34. The intermediate layer of wefts, strands 25, 26, 27 and 28, are solid monofilaments of the same diameter as the other wefts and are inserted into the fabric to assist in reducing its air permeability. It is known to use other yarns in this intermediate layer, such as spun yarns, plied monofilaments, or multifilaments.

A typical prior art fabric, made with the construction shown in FIG. 1, has an air permeability in the range of 152 to 203 $cm^3/cm^2 \cdot s$ (300–400 $ft^3/min/ft^2$). Fabric air permeability is measured using the method and calculations described in American Society for Testing and Materials Standard ASTM-D-73775-75 The air permeability figures given below were measured according to this method using a Frazier Air Permeometer.

Figure 2:
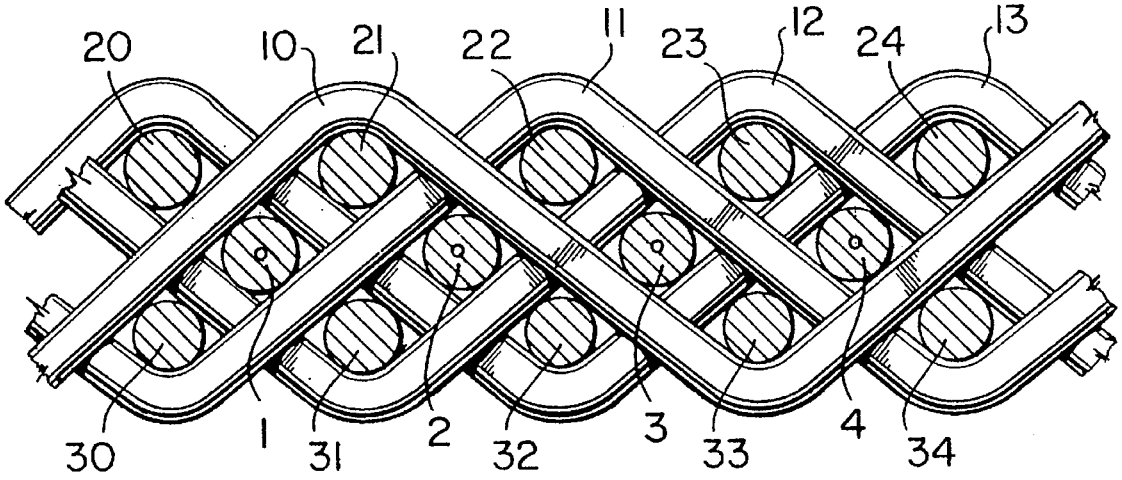
FIG.2 PRIOR ART
FIG. 2 is a sectional view of a fabric substantially identical to that shown in FIG. 1 in which the solid monofilament weft strands of the intermediate layer have been replaced with hollow monofilaments of the prior art, whose solidity is about 90%.

FIG. 2 illustrates diagrammatically a heatset dryer fabric whose weave design is substantially identical to that shown in FIG. 1. This fabric differs from that shown in FIG. 1 in that hollow monofilaments of the prior art, having a solidity of about 90% and whose diameter is substantially the same as the solid wefts, have been inserted in place of the solid monofilaments in the intermediate layer. That is, wefts 1, 2, 3 and 4, which are in the same place as wefts 25, 26, 27 and 28 in FIG. 1, are hollow monofilaments as taught by Goetmann et al. Accordingly, a cross-section taken through these high solidity strands shows that they have undergone minimal deformation when woven into a fabric and subsequently heatset. The physical properties of these prior art hollow monofilaments are so similar to those of comparably sized solid monofilaments, that the air permeability of a fabric in which they are incorporated is not significantly reduced in comparison, for example, to an identical, solid yarn fabric such as is shown in FIG. 1.

Figure 3:
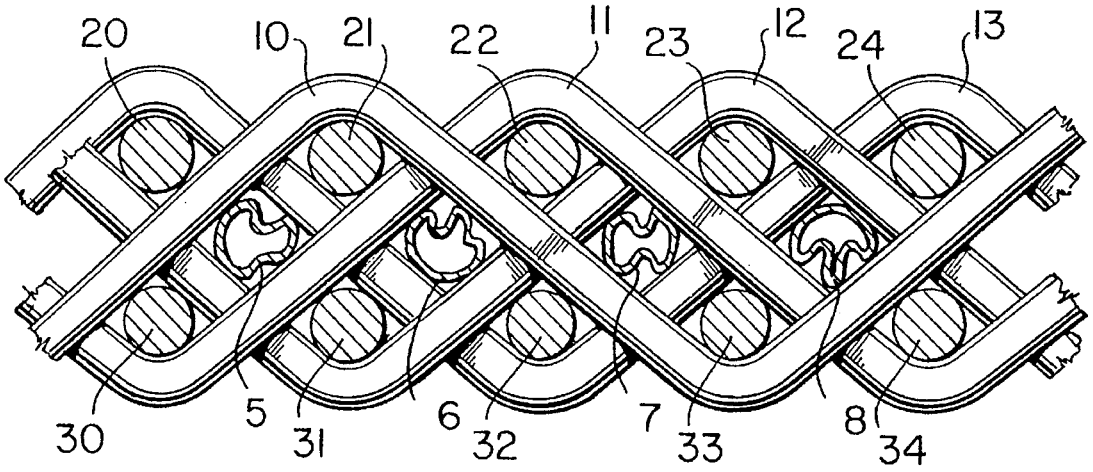
FIG. 3 is a sectional view of a fabric substantially identical to that shown in FIG. 1, in which the solid monofilament weft strands of the intermediate layer have been replaced with hollow monofilaments whose solidity is about 45%.

FIG. 3 illustrates diagrammatically a heatset dryer fabric whose weave design is also substantially identical to that shown in FIG. 1. The solid monofilament wefts, 25, 26, 27 and 28 in the intermediate layer of FIG. 1, have now been replaced with hollow monofilaments 5, 6, 7 and 8 whose solidity is approximately 45% and whose diameter is substantially the same as the solid wefts. A hollow monofilament having 45% solidity, will have a wall thickness of only some 26% of the monofilament radius. FIG. 3 is provided to illustrate the deformation which would occur to these low solidity hollow monofilaments when incorporated into the intermediate weft positions. As can be seen, the relatively thin walls of these monofilaments were crushed by the forces of weaving, and did not deform so as to fill the available space in the desired manner. Thus, these low solidity monofilaments did not achieve the desired effect of consistently reducing air permeability throughout the fabric.

Figure 4:
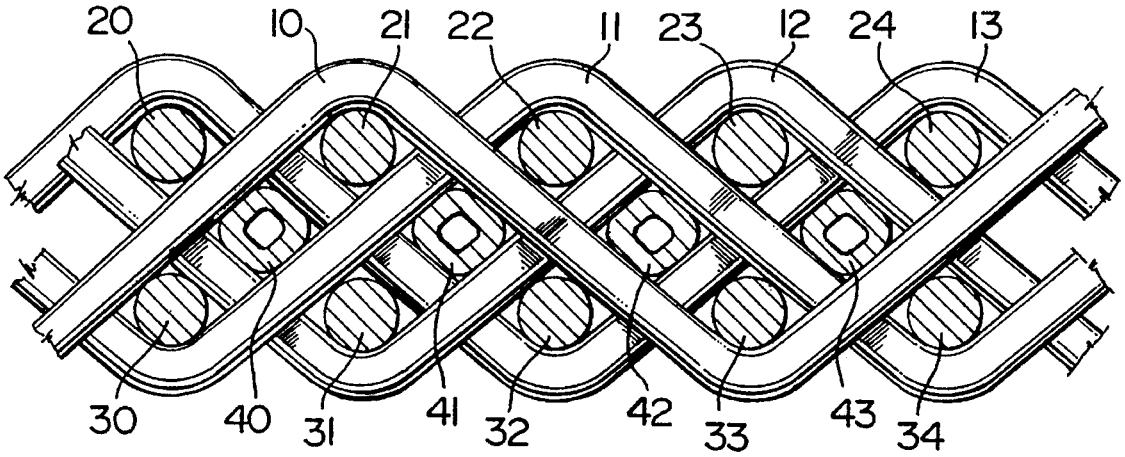
FIG. 4 is a sectional view of a fabric substantially identical to that shown in FIG. 1, in which the solid monofilament weft strands of the intermediate layer have been replaced with hollow monofilament strands according to the present invention.

FIG. 4 illustrates diagrammatically a heatset dryer fabric manufactured in accordance with the teachings of the present invention and whose weave design is substantially identical to that shown in FIG. 1. Hollow monofilament wefts 40, 41, 42 and 43, whose solidity is about 73% and whose diameter is approximately 40% greater than that of the solid wefts 25, 26, 27 and 28 in FIG. 1 they replace, have now been inserted in the intermediate layer of this fabric. It will be noted that the hollow monofilaments have deformed upon heatsetting so as to fill the perimeter of the weft passageway, thereby effectively lowering fabric air permeability in comparison to the similar fabrics of FIGS. 1, 2 and 3.

Figure 5:
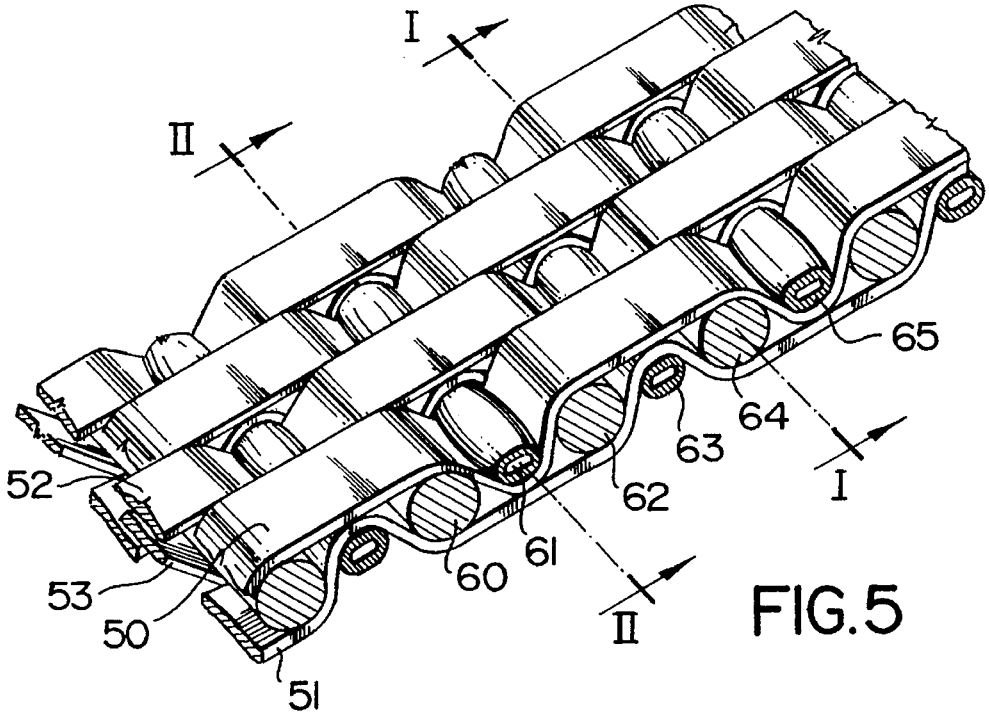
FIG. 5 is an isometric view of a single layer, all monofilament dryer fabric in which 50% of the weft strands are hollow monofilaments according to the invention.
Figure 6:
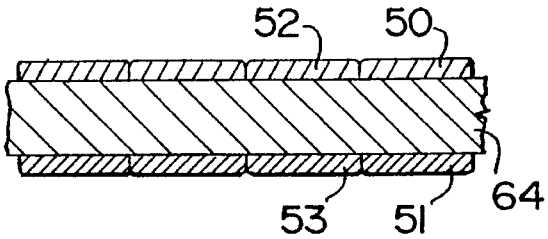
FIG. 6 is a cross-section on the line I—I in FIG. 5.
Figure 7:
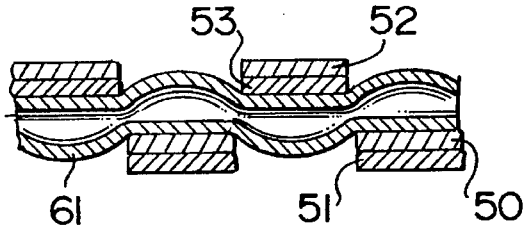
FIG. 7 is a cross section on the line II—II in FIG. 5.

FIGS. 5, 6 and 7 illustrate diagrammatically a 4-shed, 4-repeat, single layer, heatset dryer fabric, substantially as taught in U.S. Pat. No. 5,103,874 and which was woven in experimental trials. As is shown in these Figures, the warp yarns are woven in pairs so as to position one member of each warp yarn pair, 50 & 52, substantially above the other, 51 & 53. Both yarns of a warp yarn pair, 50 & 51 and 52 & 53, then pass together over the same side of each of the hollow monofilament weft yarns 61, 63 & 65. Upon heatsetting, the thicker, solid weft yarns 60, 62 & 64 remain more or less straight, whilst the thinner, hollow wefts 61, 63 & 65 are effectively deformed by warps 50 & 51 and 52 & 53 passing around them, as is shown in FIG. 7, so as to substantially fill the perimeter of the weft passageways, thereby lowering fabric air permeability. The hollow monofilaments of this invention are particularly useful when incorporated as at least a portion of the weft yarns in double warp, single layer fabrics such as are illustrated in FIG. 5.

FIG. 6 is a cross section taken at Line I—I in FIG. 5. As each warp yarn pair, 50 & 51 and 52 & 53, approaches a solid monofilament 64, their paths diverge so that one warp yarn pair member, 50 & 52, passes over solid weft 64, whilst the other warp yarn pair member, 51 & 53 passes beneath. Solid monofilament 64 has not been deformed by any appreciable amount during heatsetting so as to more effectively fill the perimeter of the weft passageway.

FIG. 7 is a cross-section taken at Line II—II in FIG. 5. This Figure is provided to illustrate the deformation occurring when a hollow monofilament, 61, that is oversized for this position in comparison to a solid weft, is used to fill the weft passageway. It will be noted that the hollow monofilament 61 is deformed during weaving and by the heatsetting process so as to more completely fill the perimeter of the weft passageway than would either a solid monofilament.

Table 1 displays the effects on fabric air permeability obtained by introducing hollow monofilaments, as at least a portion of the weft, into both multi- and single-layer dryer fabrics, identified as Samples 1 and 2, and Samples 3 and 4 respectively.

The multi-layer fabrics of FIGS. 1 and 4 were both woven in experimental trials, and are identified in Table 1 as Samples 1 and 2 respectively. Both Samples had nearly identical mesh counts, and were heatset under identical conditions. The difference between Samples 1 and 2 is that Sample 2, in accordance with the teachings of this invention, contains hollow monofilaments placed in one third of its weft positions. The 0.50 mm solid monofilament wefts in the intermediate layer of Sample 1 were replaced with 0.70 mm hollow monofilaments having a solidity of 73%. Comparing Samples 1 and 2, a reduction in fabric air permeability of about 49 $cm^3/cm^2 \cdot s$ (96 $ft^3/min/ft^2$) was achieved by replacing one-third of the solid wefts with hollow wefts of the present invention.

The data of Samples 3 and 4 in Table 1 was obtained from two 4-shed, 4-repeat single layer dryer fabrics, substantially as shown in FIGS. 5, 6 and 7, which were woven in experimental trials. In Sample 3, all of the weft yarns were solid monofilaments with diameters of 0.5 mm and 0.9 mm and placed in alternating positions. In Sample 4, 0.7 mm diameter hollow monofilaments of 73% solidity replace every 0.5 mm solid weft yarn in Sample 3. Both Samples have substantially the same mesh counts and were heatset under identical conditions. Comparing Samples 3 and 4, it will be seen that a reduction in fabric air permeability of 46 $cm^3/cm^2 \cdot s$ (90 $ft^3/min/ft^2$) was achieved by replacing one-half of the solid wefts of Sample 3 with hollow wefts according to the present invention, as in Sample 4.

TABLE 1

Effect of Hollow Monofilaments on Dryer Fabric Air Permeability

| | Sample 1 | Sample 2 |
|---|---|---|
| Mesh ($cm^{-1}$) (a) | 16.9 × 19.5 | 16.9 × 18.7 |
| Solid Monofilament Size (mm) | 0.5 | 0.5 |
| % Solid Wefts | 100 | 67 |
| Hollow Monofilament Size (mm) | n/a | 0.7 |
| % Hollow Wefts | 0 | 33 |
| Hollow Weft Solidity (%) | n/a | 73 |
| Air Permeability ($cm^3/cm^2 \cdot s$) (b) | 176 | 127 |
| Difference in Dryer Fabric Air Permeability (Sample 1 – Sample 2) = 49 $cm^3/cm^2 \cdot s$ | | |
| | **Sample 3** | **Sample 4** |
| Mesh ($cm^{-1}$) (a) | 22.4 × 1.5 | 22.8 × 7.5 |
| Solid Monofilament Size (mm) | 0.9 & 0.5 | 0.9 |
| % Solid Wefts | 100 | 50 |
| Hollow Monofilament Size (mm) | n/a | 0.7 |
| % Hollow Wefts | 0 | 50 |
| Hollow Weft Solidity (%) | n/a | 73 |
| Air Permeability ($cm^3/cm^2 \cdot s$) (b) | 84 | 38 |
| Difference in Dryer Fabric Air Permeability (Sample 3 – Sample 4) = 46 $cm^3/cm^2 \cdot s$ | | |

NOTES:
(a) mesh count = number of Warps per cm × number of Wefts per cm
(b) air permeability as measured by test method ASTM-D-737-15.

Table 1 shows that, under equivalent manufacturing conditions, a substantial reduction in air permeability is achieved by the introduction of hollow weft, which fill more completely the weft passageway than the solid weft they replace, as a portion of the cross machine direction strands.

A hollow monofilament, whose size and solidity are determined in accordance with the teachings of this invention, will effectively replace a solid monofilament in various fabric designs. This is because such a hollow monofilament is more readily deformable and will fill the available space in the fabric more effectively than a solid, and relatively unmalleable, monofilament. This deformation will allow a fabric to attain a lower air permeability than a comparable fabric, containing either solid monofilaments in the same positions and manufactured under equivalent conditions, or one containing hollow monofilaments whose size and solidity are not selected according to the criteria provided herein.

All of the solid monofilament weft yarns in a woven fabric can be replaced with hollow monofilament yarns. Table 2 shows data obtained by replacing all the solid monofilament wefts in a multilayer fabric with slightly larger hollow monofilaments. Both woven samples have nearly identical mesh counts, and were heatset under identical conditions. In Sample 6, 0.55 mm hollow monofilaments replace all of the 0.40 mm solid monofilaments of Sample 5. A reduction in fabric air permeability of about 23 $cm^3/cm^2 \cdot s$ (45 $ft^3/min/ft^2$) was achieved in Sample 6 over Sample 5.

TABLE 2

Effect on Fabric Air Permeability obtained by Replacing all Solid Monofilaments with Hollow Monofilaments

| | Sample 5 | Sample 6 |
|---|---|---|
| Mesh ($cm^{-1}$) | 20.3 × 21.1 | 20.3 × 17.7 |
| Solid Monofilament Size, mm | 0.40 | n/a |
| % Solid Wefts | 100 | Zero. |
| Hollow Monofilament Size, mm | n/a | 0.55 |
| % Hollow Wefts | Zero | 100 |
| Hollow Weft solidity, % | n/a | 73 |
| Air Permeability, $cm^3/cm^2 \cdot s$) | 66 | 43 |

Difference in air permeability, Sample 5 – Sample 6: 23 $cm^3/cm^2 \cdot s$.

Figure 8:
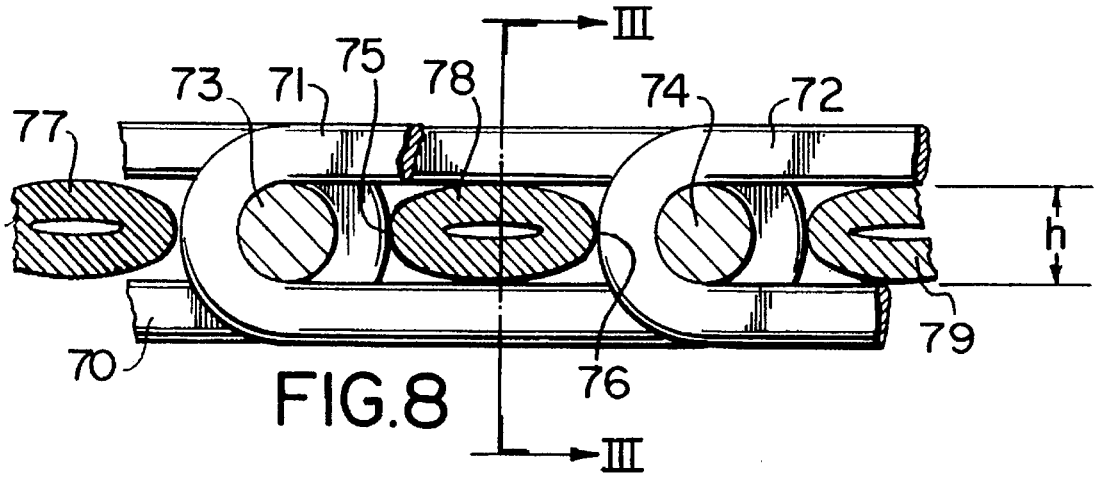
FIG. 8 is a sectional view of a spiral fabric into which hollow monofilaments have been inserted according to the invention.
Figure 9:
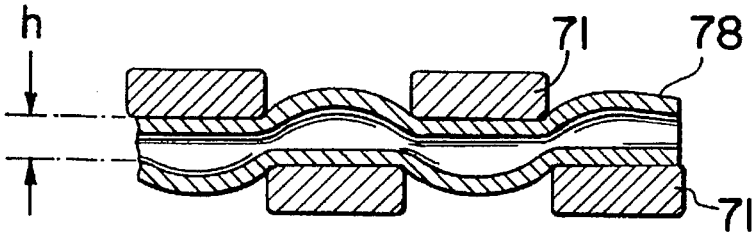
FIG. 9 is a cross-section on line III—III of FIG. 8.

FIGS. 8 and 9 illustrate a diagrammatically spiral fabric into which hollow monofilaments have been inserted within the helical coils and between the hinge yarns. In this form of dryer fabric, a sequence of helical coils, as at 70, 71, 72, in which the axes of the helices are in the weft direction, are joined together by inserted hinge yarns as at 73 and 74, which are also in the weft direction. In this example, the helical coils adopt a flattened, somewhat oval, configuration after heatsetting, as is shown in FIG. 8. The length of the minor axis of the internal void area of the helical coil is labelled "h".

The internal void volume between adjacent areas of the helical coils of such a fabric, as at 75 and 76, is free space and contributes directly to the air permeability of the fabric. As shown in FIG. 8, a hollow monofilament as at 77, 78 and 79, whose outside diameter is greater than or equal to the length h of the minor axis of the helical coils after heatsetting, has been inserted into the middle of the joined helical coils during fabric construction. When the fabric is heatset, the length h of the minor axis of the helical coil is reduced and the hollow monofilament is deformed into a somewhat oval shape, effectively and efficiently filling the internal void volume within the coil, as shown at 78, so as to decrease fabric air permeability.

We have found that hollow monofilaments are most effective in this position when their outside diameter, prior to heatsetting, is equal to or greater than the length, h, of the minor axis of the heatset coil into which they have been inserted. This causes the monofilaments to deform during heatsetting, which serves to hold them in place and prevents the yarns from falling out of the fabric during its life on the paper machine. This deformation of the hollow monofilament in a spiral fabric can be seen in the cross-section parallel to the axis of the spiral shown in FIG. 9.

As previously noted, the useful range of hollow monofilament solidities of this invention is from about 50% to about 80%, and is preferably from about 55% to about 78%, and is most preferably from about 60% to about 75%. We have found that this range of solidities is also critical to spiral fabrics because it provides the hollow monofilaments with:

a) sufficient stiffness to allow them to be inserted into the helical coils and between the hinge yarns by methods currently known in the manufacture of spiral fabrics, and b) sufficient malleability to allow them to deform during further processing, so as to fill the interstitial spaces within the helical coils and between the hinge yarns; this deformability is the critical factor in lowering fabric air permeability.

Table 3 displays data relating to spiral fabrics which have been assembled using helices made entirely of PET, and into which both solid and hollow monofilaments also made from PET have been inserted into the spaces within the helical coils and between the hinge yarns. All samples were manufactured and heatset under identical conditions. Sample A does not contain any yarns inserted into this position, and therefore acts as a control. So-called "dog-bone" shaped solid monofilaments have been inserted into this same position in Sample B. Samples C-F contain hollow monofilaments of progressively greater diameters and varying solidities inserted into the spaces within the helical coils and between the hinge yarns. The number of spirals per centimeter of cross machine direction (spiral count), hinge yarns per centimeter of machine direction (yarn count), and the hinge yarn diameter, are the same for all samples.

As can be seen from Table 3, a significant reduction in fabric air permeability is achieved by inserting hollow monofilaments, whose diameter, prior to heatsetting, is from 1.8 mm to 2.1 mm, into the spaces within the helical coils and between. the hinge yarns. The bottom row of Table 3, labelled "Air Permeability Net Change", shows the net difference in air permeability obtained from each sample in comparison to the control, Sample A. For example, the air permeability of Sample C has been reduced by 252 $cm^3/cm^2 \cdot sec$ (495 $ft^3/min/ft^2$) in comparison to the control by the insertion of 1.8 mm hollow monofilaments. Similarly, the air permeability of Samples D and E have been reduced by 276 $cm^3/cm^2 \cdot sec$ (542 $ft^3/min/ft^2$) and 312 $cm^3/cm^2 \cdot sec$ (613 $ft^3/min/ft^2$) respectively by insertion of 1.9 mm and 2.0 mm diameter hollow monofilaments. A net change in air permeability of 332 $cm^3/cm^2 \cdot sec$ (652 $ft^3/min/ft^2$) in comparison to the control is realized when a larger, 2.1 mm diameter hollow monofilament, is inserted into the same position, as in Sample F.

TABLE 3

Effect on Spiral Fabric Air Permeability obtained by Inserting Hollow Monofilaments made from PET

| | SAMPLE NO | | | | | |
|---|---|---|---|---|---|---|
| Parameter | A | B | C | D | E | F |
| Spiral Count ($cm^{-1}$) | 6.5 | 6.5 | 6.5 | 6.5 | 6.5 | 6.5 |
| Hinge Yarn Count ($cm^{-1}$) | 2.4 | 2.4 | 2.4 | 2.4 | 2.4 | 2.4 |

TABLE 3-continued

Effect on Spiral Fabric Air Permeability obtained by Inserting Hollow Monofilaments made from PET

| | SAMPLE NO | | | | | |
|---|---|---|---|---|---|---|
| Parameter | A | B | C | D | E | F |
| Hinge Yarn Diameter (mm) | 0.10 | 0.70 | 0.70 | 0.70 | 0.70 | 0.70 |
| Inserted Weft Size (mm) | n/a | 0.45 × 2.2 | 1.8 | 1.9 | 2.0 | 2.1 |
| Inserted Weft Solidity (%) | n/a | 100 | 63.4 | 74.2 | 65.9 | 66.5 |
| Fabric Air Permeability ($cm^3/cm^2 \cdot sec$) | 432 | 196 | 180 | 156 | 120 | 100 |
| Fabric Air Permeability Net Change | 0 | 236 | 252 | 276 | 312 | 332 |

The data displayed in Table 3 shows that, in general, as the unheatset solidity and diameter of the hollow monofilaments increase together, heatset fabric air permeability values decrease. We have found that the optimum range of solidity of hollow monofilaments is from about 50% to about 80%, with from about 55% to about 78% being more effective, whilst solidities of from about 60% to about 75% are most effective in reducing fabric air permeability. We have also found that the effective diameter of the inserted hollow monofilaments prior to heatsetting will be a function of the length h of the minor axis of the heatset helical coils into which they have been inserted, and this diameter should be equal to, and is preferably greater than, the length h of the minor axis of the heatset helical coil.

Table 4 displays data obtained from PET spiral fabrics into which hollow monofilaments made from polybutylene terephthalate (PBT), or a blend of 10% HYTREL® in PET, have been inserted into the spaces within the helical coils and between the hinge yarns. Fabric Samples G and H contain hollow monofilaments made from PBT, and Samples J, K and L contain hollow monofilaments extruded from a blend of 10% HYTREL® in PET. The design of the fabric samples used to obtain this data is substantially identical to that used in the samples of Table 3 and all were manufactured and heatset under identical conditions. All air permeability net changes are again made in comparison to the control, Sample A, which is the same control used in Table 3. HYTREL® is a registered trademark of DuPont and is a polyester elastomer.

TABLE 4

Effect on Spiral Fabric Air Permeability Obtained by Inserting Hollow Monofilaments made from PBT or 10% HYTREL in PET

| | SAMPLE NO. | | | | | |
|---|---|---|---|---|---|---|
| Parameter | A | G | H | J | K | L |
| Spiral Count ($cm^{-1}$) | 6.5 | 6.5 | 6.5 | 6.5 | 6.5 | 6.5 |
| Hinge Yarn Count ($cm^{-1}$) | 2.4 | 2.4 | 2.4 | 2.4 | 2.4 | 2.4 |
| Hinge Yarn Diameter (mm) | 0.70 | 0.70 | 0.70 | 0.70 | 0.70 | 0.70 |
| Inserted Weft Diameter (mm) | n/a | 2.0 | 2.1 | 1.7 | 1.9 | 2.0 |
| Inserted Weft Solidity (%) | n/a | 56.3 | 60.4 | 71.9 | 72.6 | 72.0 |
| Fabric Air | 432 | 199 | 140 | 269 | 232 | 156 |

TABLE 4-continued

Effect on Spiral Fabric Air Permeability Obtained by Inserting Hollow Monofilaments made from PBT or 10% HYTREL in PET

| Parameter | SAMPLE NO. A | G | H | J | K | L |
|---|---|---|---|---|---|---|
| Permeability ($cm^3/cm^2 \cdot sec$) | | | | | | |
| Fabric Air Permeability Nat Change | 0 | 233 | 292 | 163 | 200 | 276 |

The data provided in Table 4 shows that the hollow PBT monofilaments of Samples G and H, and the hollow yarns made from 10% HYTREL in PET of Samples J, K and L, were both effective upon heatsetting in reducing fabric air permeability. Table 4 shows that it is possible to obtain net reductions in fabric air permeability which are similar to those obtained using hollow PET monofilaments by using other polymers under equivalent manufacturing conditions. The data displayed in Tables 3 and 4 indicate that hollow monofilaments made from PET are the most effective in reducing spiral fabric air permeability, while the polymer blend of 10% HYTREL® in PET is less effective, and PBT is the least effective among the polymers tested.

Although the selection of the polymer from which the hollow monofilaments are made will have an impact on the effectiveness of these strands in reducing fabric air permeability, we have found that varying the solidity of the strands is the most effective means of decreasing fabric air permeability. Thermoplastic polymers other than PET, PBT, and blends thereof, may be found which will provide hollow monofilaments whose physical properties and characteristics would make them successful candidates for use in the fabrics of this invention. Polyphenylene sulphide (PPS) and polyetherether ketone (PEEK) are examples of such polymers, but the invention is not limited to the polymers referenced herein. In experimental and field trials to date, we have found that PET is an effective polymer for these applications.

As previously noted, the useful diameter of the hollow monofilaments intended for use in woven fabrics will generally be in the range of from about 0.25 mm to about 1.2 mm, while spiral fabrics will utilize yarns whose diameter is from about 0.50 mm to about 2.1 mm. The most effective strand diameter for a particular application will be a function of the available space in the fabric: in a woven fabric, the circumference of the strand will ideally be greater than or equal to the perimeter of the weft passageway in the heatset fabric into which it will be placed, whilst in a spiral fabric, the strand diameter will ideally be greater than the interior length of the minor axis of the heatset spiral.

A significant portion of the expense of manufacturing dryer fabrics is the cost of the material used. By replacing at least a portion of the solid monofilament wefts with hollow monofilaments of the same diameter in a dryer fabric, the mass of material used per unit area of fabric can be reduced, and a reduction in material costs can be realized. This is particularly important when expensive polymers, such as PPS and PEEK, are used to make the monofilaments.

Wide industrial looms, up to 15 meters in width, are used in the manufacture of dryer fabrics. The requirement to traverse such distances, in a minimum of time, with a shuttle that carries the weft strands, demands high levels of acceleration and deceleration of both the shuttle and the strand at each side of the loom. The weft strands used in modern dryer fabric designs, particularly single layer designs, can be relatively massive (from about 0.7 mm to about 1.2 mm in diameter). The inertial effects associated with the acceleration and deceleration of these large wefts can cause difficulties in weaving, resulting in fabric defects and lowered production.

For example, the monofilament can pull out of the shuttle upon acceleration, and thus not be carried across the entire width of the loom, creating a defect in the fabric called a "dropped weft". On deceleration of the shuttle at the opposite side of the loom, the monofilament can continue to traverse the loom after the shuttle has stopped, thus providing a length of monofilament that is greater than the width of the loom. On beat-up into the fabric, the excess length of monofilament is trapped in the fabric, creating a defect called a "double weft". One method of reducing defects such as these, which are caused by inertial effects, is to reduce the mass of the solid monofilament used as the weft strand by replacing it with a hollow monofilament of substantially the same overall diameter.

Other embodiments of the invention may be made using the principles claimed herein. The specific embodiments should not be considered as limitations of the invention.

The embodiments of the invention in which an exclusive property or privilege is claimed are defined as follows:

1. A heatset fabric, including weft strands, for use in papermaking machines, wherein at least a portion of the weft strands are hollow thermoplastic polymer monofilaments which, prior to heat setting, have a solidity in their undeformed cross-sectional area of from about 60% to about 75%, and wherein the circumference of said hollow monofilaments is greater than, or equal to, the perimeter of the weft passageway they are to occupy in the fabric after heatsetting.

2. A woven, heatset fabric, for use in paper making machines, wherein at least a portion of the weft strands are hollow thermoplastic monofilaments which, prior to heat setting, have a solidity in their undeformed cross-sectional area of from about 60% to about 75% and wherein the circumference of said hollow monofilaments is greater than, or equal to, the perimeter of the weft passageway they are to occupy in the fabric after heatsetting.

3. A heatset spiral fabric, for use in papermaking machines, comprising a plurality of helical coils interconnected by hinge yarns, including hollow monofilament weft yarns which, prior to heat setting, have a solidity in their undeformed cross sectional area of from about 60% to about 75%, located within the helical coils and between the hinge yarns, wherein the diameter of said hollow monofilaments is greater than the interior length of the minor axis of the helical coils in the heat set fabric, and further wherein the hollow monofilaments are deformed by the helical coils as a consequence of heatsetting the fabric.

* * * * *